US008667976B2

(12) United States Patent
Huang

(10) Patent No.: US 8,667,976 B2
(45) Date of Patent: Mar. 11, 2014

(54) HEIGHT SELF-ADJUSTING WALKING AID

(76) Inventor: Junbiao Huang, Guangdong (CN)

( * ) Notice: Subject to any disclaimer, the term of this patent is extended or adjusted under 35 U.S.C. 154(b) by 80 days.

(21) Appl. No.: 13/230,907

(22) Filed: Sep. 13, 2011

(65) Prior Publication Data

US 2013/0061892 A1 Mar. 14, 2013

(51) Int. Cl.
*A61H 3/00* (2006.01)

(52) U.S. Cl.
USPC ..... 135/67

(58) Field of Classification Search
USPC ..... 135/67; 482/66
See application file for complete search history.

(56) References Cited

U.S. PATENT DOCUMENTS 3,455,313 A * 7/1969 King ..... 135/67
3,783,886 A * 1/1974 Thomas ..... 135/67
4,777,973 A * 10/1988 Nakajima ..... 135/67
4,830,035 A * 5/1989 Liu ..... 135/67
5,349,977 A * 9/1994 Wood ..... 135/67
5,649,558 A * 7/1997 Richard ..... 135/67
5,740,825 A * 4/1998 Brunengo ..... 135/67
6,145,524 A * 11/2000 Li et al. ..... 135/67
6,453,921 B1 * 9/2002 Rost ..... 135/67
8,302,974 B2 * 11/2012 Kline ..... 280/43

* cited by examiner

*Primary Examiner* — Noah Chandler Hawk
(74) *Attorney, Agent, or Firm* — Whitham Curtis Christofferson & Cook, PC

(57) ABSTRACT

A height self-adjustable walking aid includes two oppositely arranged U-shaped stands which are connected by a front stand. The two ends of each U-shaped stand are sleeved with two outer pipes respectively, and each outer pipe is mounted with a height adjusting apparatus and a control apparatus for height adjusting. The walking aid is adjustable in height according to the heights of users, so as to satisfy the requirement of allowing patients or elders with different heights to use a same equipment, thus providing great convenience for users. The heights of the two ends of each U-shaped stand could be adjustable respectively to generate a height difference between the front end and rear end of the walking end, thus enabling patients or elders to walk up and down the stairs with it.

15 Claims, 13 Drawing Sheets

HEIGHT SELF-ADJUSTING WALKING AID

TECHNICAL FIELD

The present invention relates to a walking aid for helping the patients or elders having mobility difficulties walk up or down the stairs.

BACKGROUND INFORMATION

For the patients or elders with mobility difficulties, as walking by themselves has been a big problem, these people have to sit or lie down for hours every day. This is not a good sign for patients' recovery. In addition, long-time sitting and lying may accelerate the degeneration of the body functions, as well as impose the burden put on the nurses. In order to enable the patients or elders having mobility difficulties to walk by themselves, consequently to help them heal quickly, prevent from body function degeneration, and defer senescence, a walking aid is invented to assist the patients or elders who have mobility difficulties to walk or stand for rest. With the walking aid, the patients or elders could walk or stand for rest against the walking aid independently. However, the conventional walking aids have not provide with the convenience in height self-adjustment thus the users have to bent to adjust the heights of the stands one by one by hand; and those walking aids cannot guarantee the consistence in heights of the stands, in particular, those walking aids can't assist the patients or elders to walk up or down the stairs.

SUMMARY OF THE INVENTION

In order to overcome the defects of the prior art, the present invention provides a walking aid of which height is self-adjustable according to actual needs, in which the heights of the four pipes could be adjusted simultaneously without need for the users to bent down, and the consistence in heights of the different pipes is guaranteed, hereby it could satisfy the need of allowing the patients or elders with different heights to use a same equipment, in walking up or down the stairs.

The technical solution adopted by the present invention could be described as:

A height self-adjustable walking aid disclosed by the present invention, comprises two oppositely arranged U-shaped stands which are connected together by a front stand, the two ends of each U-shaped stand being sleeved with two outer pipes respectively, a height adjusting apparatus being mounted between each sleeve and the corresponding U-shaped stand, a control apparatus for height adjusting being mounted inside each U-shaped stand.

As a preferred embodiment of the present invention, wherein each height adjusting apparatus comprises an inner driving medium with a return spring, each outer pipe is provided with a plurality of positioning holes in the sidewall thereof, the inner driving medium is provided with a bar-shaped groove in which an inner moving part is mounted, one end of the moving part is inserted into the positioning hole, the other end is mounted with a reset spring, the inner driving medium further has an inclined plane on the bottom thereof, which is able to drive the inner moving part to move radially when the inner driving medium is moving.

As the first preferred embodiment of the present invention, a control apparatus for height adjusting comprises a cable disposed in the U-shaped stand and of which two ends are respectively and fixedly connected with the two inner driving mediums mounted in a U-shaped stand, a adjusting part is pivoted in the U-shaped stand, and the middle part of the cable is fixedly connected on the adjusting part, in the U-shaped stand an adjustment driving medium is mounted, of which one end penetrates the U-shaped stand and extends to the outside of the U-shaped stand, and the other end is in contact with the adjusting part, a hand-push part which is cooperated with the adjustment driving medium is pivoted in the U-shaped stand.

In addition to above, in each outer pipe an inner part is mounted, in which an inner moving part is mounted, and a reset spring is mounted between the inner moving part and the inner part.

Furthermore, in each U-shaped stand an adjusting part installation box is mounted, in which the adjusting part is mounted.

As a refinement to the above embodiment, in each U-shaped stand a cable adjusting sleeve is mounted.

As the second preferred embodiment of the present invention, in each U-shaped stand the control apparatus for height adjusting mounted comprises two adjusting parts and an adjustment driving medium, one end of the adjustment driving medium penetrates the U-shaped stand and extends to the outside of the U-shaped stand, the other end is in contact with the two adjusting parts, the two adjusting parts are moveable within the U-shaped stand under the pressure by the adjustment driving medium, one adjusting part is connected with an inner driving medium through the first cable, the other regulator is connected with the other inner driving medium through the second cable, the hand-push part which is cooperated with the adjustment driving medium is pivoted in the U-shaped stand.

Each adjusting part has an inclined plane; accordingly each adjustment driving medium has a wedge block which is cooperated with the inclined plane.

In each U-shaped stand a adjusting part installation box is mounted, the adjusting part installation box is provided with a sliding groove in the inside thereof, in which an adjusting part is mounted.

A moving part is sleeved on each U-shaped stand, the moving part is able to rotate along the U-shaped stand, and provided with an arc-shaped hole, the two ends of the front stand are respectively and fixedly connected with the moving parts on the two U-shaped stands, each U-shaped stand is provided with a hole, in each U-shaped stand a spring leaf is mounted, of which one end is mounted with a spring leaf positioning part, one end of the spring leaf positioning part penetrates the hole and extends into the arch-shaped hole.

Furthermore, one end of each moving part is mounted with a moving part upper sleeve, the other end is fixedly connected with a marble moving part, which is cooperated with a marble fixing part mounted in the U-shaped stand, a marble and a marble spring are mounted between the marble moving part and marble fixing part, the marble moving part has a groove on the end surface thereof for receiving the marble.

A reinforcing pipe is mounted on each U-shaped stand.

A rubber pad is mounted on the end of each outer pipe through a universal joint.

A foam handle is mounted on the hand grabbing portion of each U-shaped stand.

In addition, one of the U-shaped stands is mounted with a first connecting pipe, another U-shaped pipe is mounted with a second connecting pipe, wherein one end of the first connecting pipe is inserted into the second connecting pipe, and a connector is mounted between the first and second pipes.

The advantages of the present invention could be summarized as: the present invention includes a height adjusting apparatus and a control apparatus for height adjusting in the equipment, to realize the height adjustment according to the height of the user, so as to satisfy the requirement of allowing the patients or elders with different heights to uses a same equipment, providing numerous conveniences for the users. In addition, the walking aid disclosed by the present invention is foldable through some moving parts, whereby occupying less space in transportation or idle state.

BRIEF DESCRIPTION OF THE DRAWINGS

Further details and advantages of the present invention are explained using embodiments, with reference to the attached drawings. In the drawings.

DESCRIPTION OF EMBODIMENTS

Figure 1:
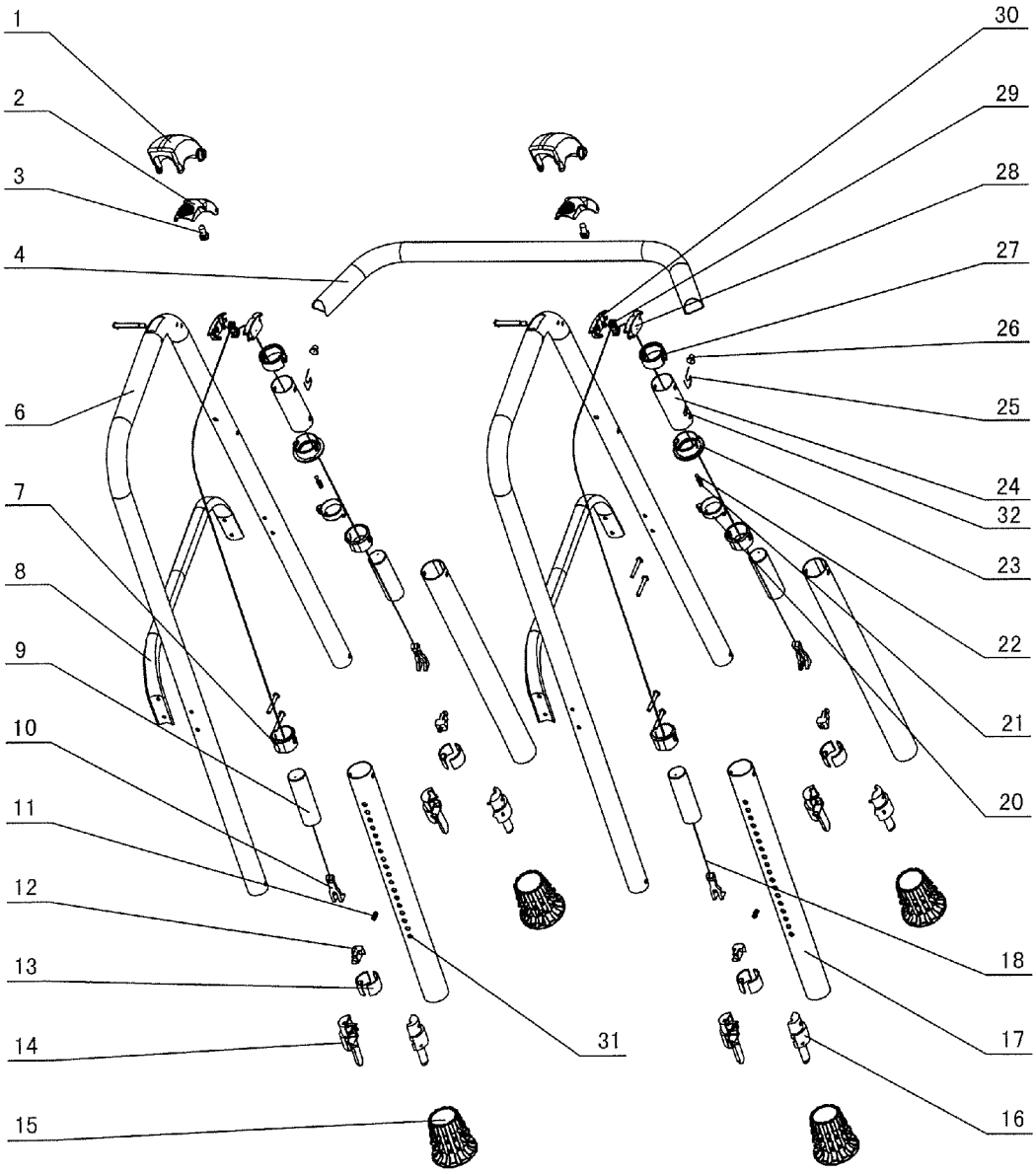
FIG. 1 is an exploded view of the first embodiment of the present invention.
Figure 2:
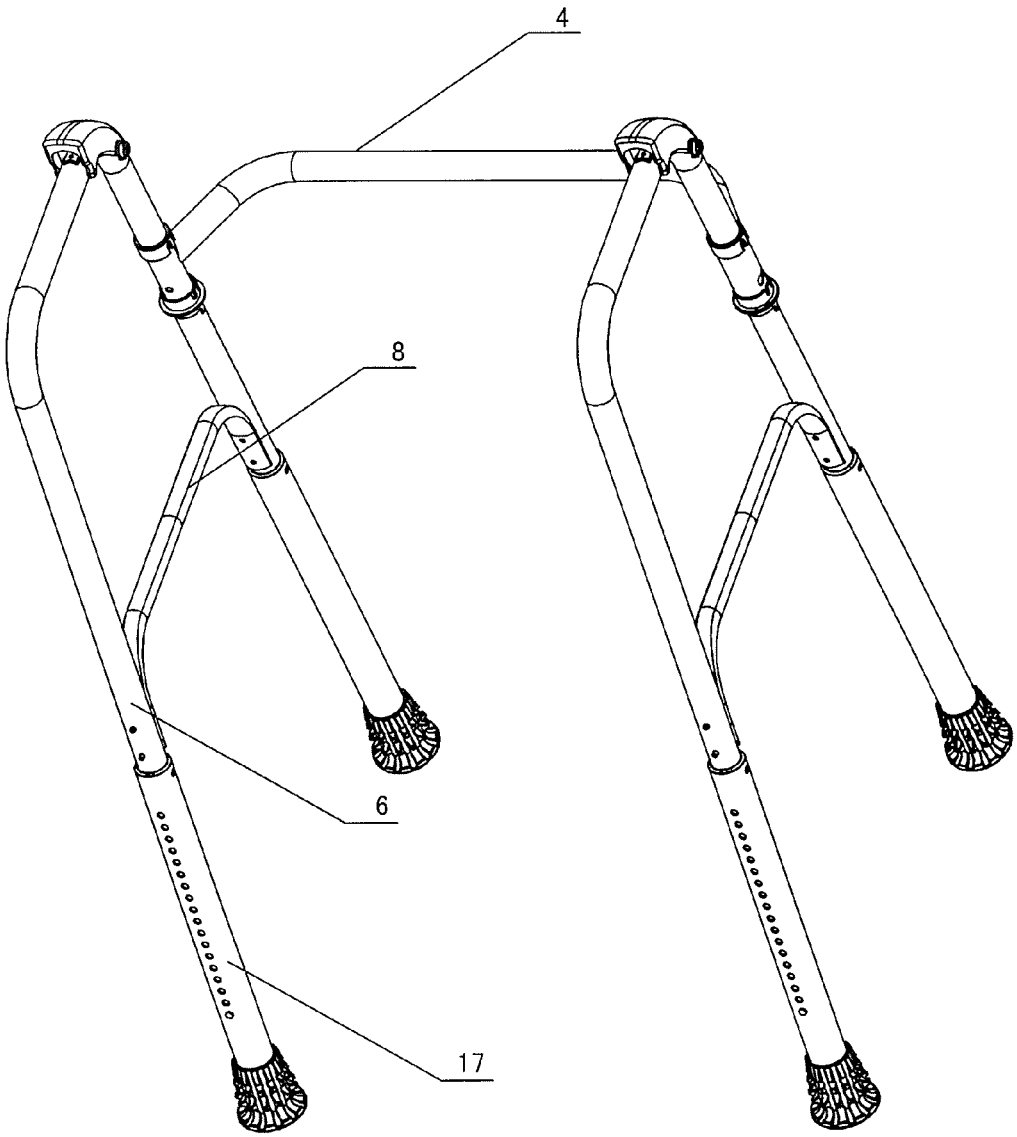
FIG. 2 is a schematic view of the structure of a walking aid of the present invention in use status.
Figure 3:
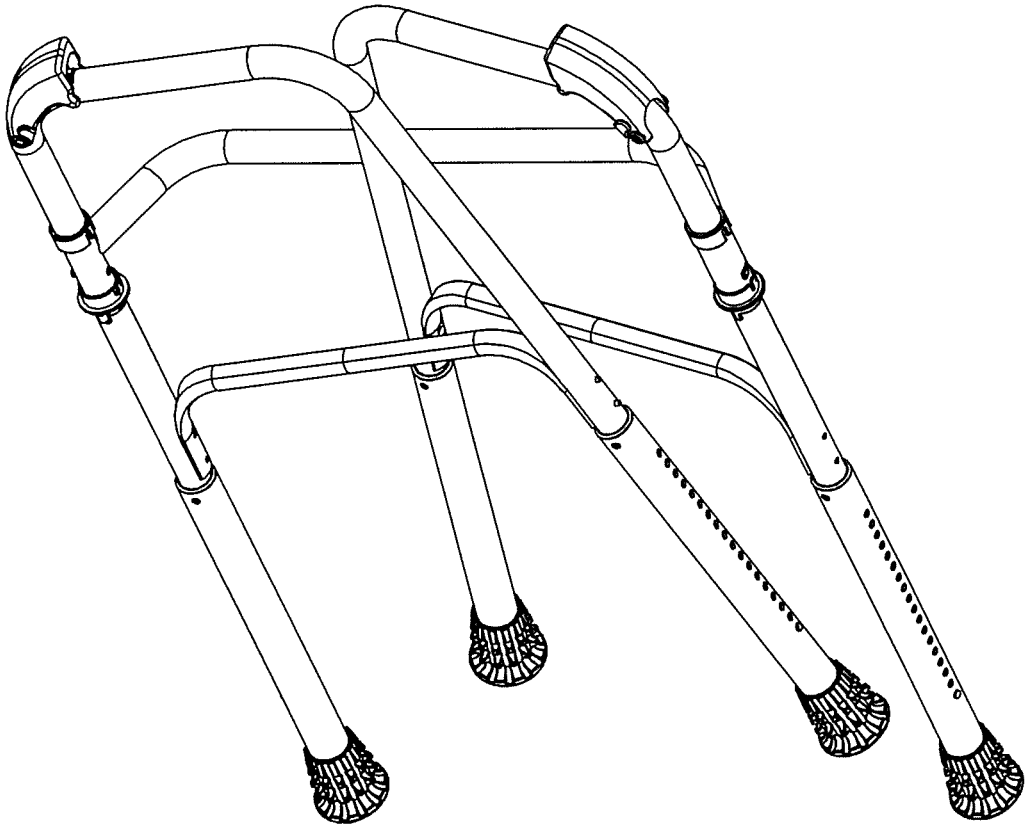
FIG. 3 is a schematic view of the walking aid of the present invention in folded status.
Figure 4:
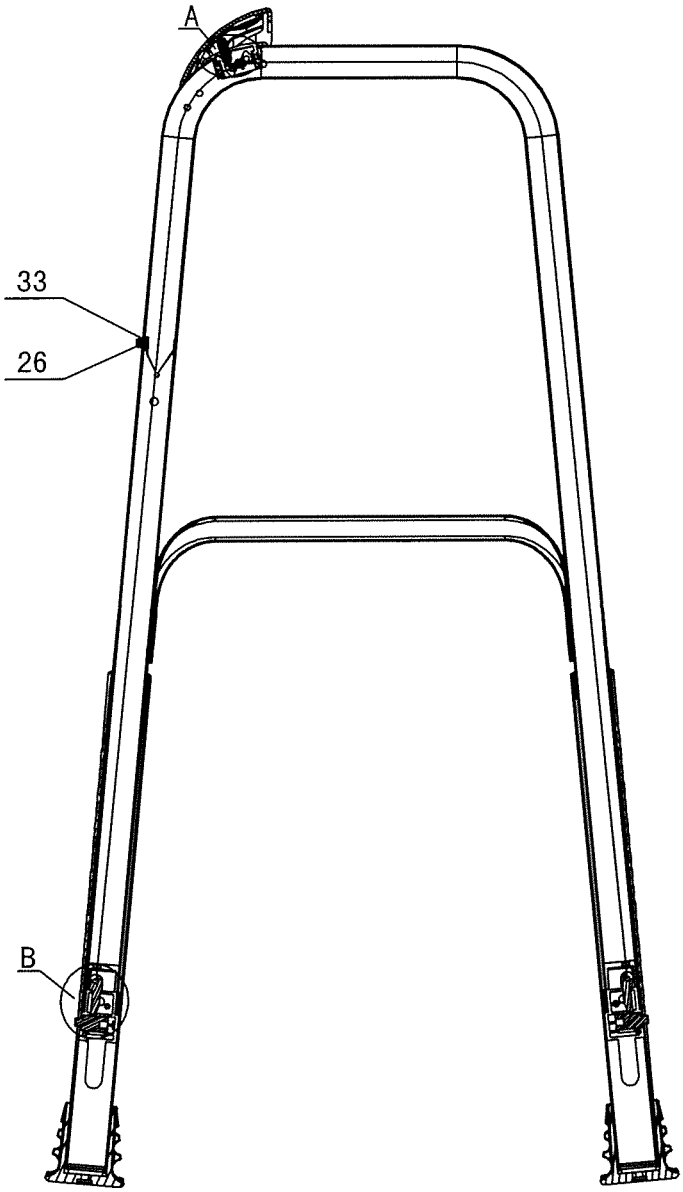
FIG. 4 a schematic view of the walking aid of the present invention in height-locked status.

As showed in FIG. 1 to 12, a height self-adjusting walking aid, disclosed by the present invention, comprises two oppositely arranged U-shaped stand 6 which are connected by a front stand 4. Furthermore, two outer pipes 17 are respectively sleeved on the two ends of each U-shaped stand 6, an outer pipe sleeve 7 is disposed between each outer pipe 17 and the corresponding U-shaped stand 6, and a rubber cushion is mounted on the bottom of each outer pipe. The height self-adjusting walking aid further comprises a height adjusting apparatus mounted between each outer pipe and the corresponding U-shaped stand, and a control apparatus for height adjusting mounted inside each U-shaped stand. The device disclosed by the present invention enables the elders and patients having mobility difficulties to walk or stand for a while for a rest independently, and it is self-adjustable in height according to the height of the user, so as to satisfy the requirement of enabling the elders or patients in different height ranges to use a same walking aid, whereby providing great convenience for users. At the same time, through the height adjusting apparatus and the control apparatus for height adjusting, the heights of the two ends of a U-shaped stand can be adjusted respectively, so as to facilitate the elders and patients to go up or down the stairs.

Figure 10:
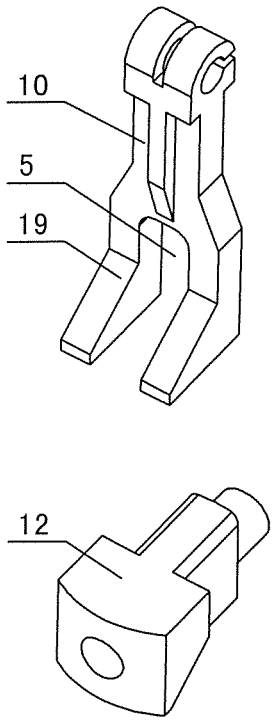
FIG. 10 is a structural view of the structure of the inner driving medium and inner moving part.
Figure 11:
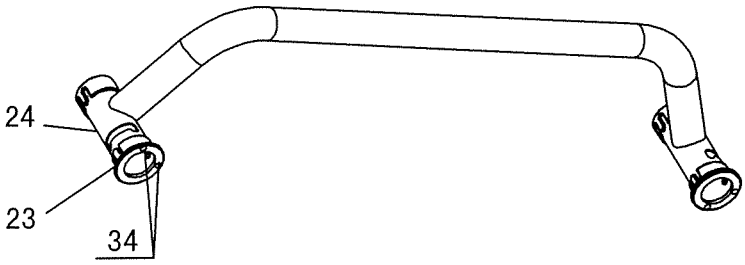
FIG. 11 is a schematic view of the marble moving part.
Figure 12:
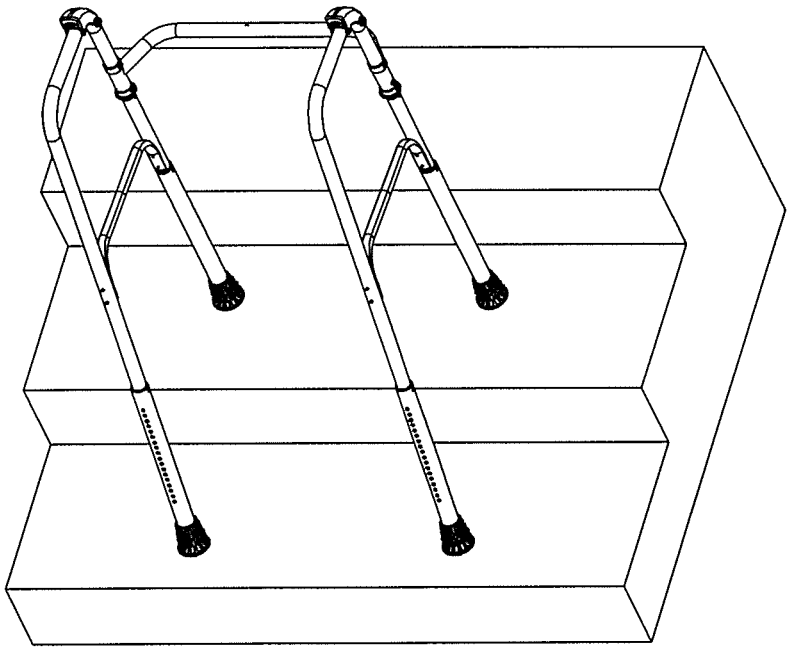
FIG. 12 is a schematic view of the first embodiment of the present invention in use.

As shown by FIG. 1, a control apparatus for height adjusting according to the present invention comprises an inner driving medium 10 and a return spring, the outer pipe 17 is provided with a plurality of positioning holes 31 in the sidewall thereof, the inner driving medium 10 is provided with a bar-shaped groove 5, in which an inner moving part 12 is mounted, one end of the inner moving part 12 is inserted into a positioning hole 31, and the other end is mounted with a reset spring 11. For convenience in positioning the inner moving part 12, an inner part consisting of an inner part upper cover 12 and an inner part lower cover 16 is mounted in the out pipe 17, and sleeved with an inner part fixing sleeve 13, the inner moving part 12 is mounted in the inner part, and the reset spring 11 is mounted between the inner moving part 12 and inner part. In addition to above, the inner driving medium 10 is provided with an inclined plane 19 on the bottom thereof, as shown in FIG. 10, when the inner driving medium 10 is moving, it drives the inner moving part 12 to move radially through the inclined plane 19, and leave from the positioning hole 31.

As shown by the FIGs, the control apparatus for height adjusting used in the present invention comprises a cable 18 disposed in each U-shaped stand 6, the two ends of the cable 18 are respectively and fixedly connected with the two inner driving mediums 10 disposed within the U-shaped stand, an adjusting part installation box consisting of a upper cover 28 and a lower cover 29 is mounted in the U-shaped stand 6. In the adjusting part installation box an adjusting part 29 is pivoted on the U-shaped stand 6, and fixedly connected to the middle of the cable 18. Within the U-shaped stand 6, an adjustment transmission part 3 is mounted, of which one end penetrates the U-shaped stand 6 and extends to the outside of the U-shaped stand 6, and the other end is in contact with the adjusting part 29. A hand-push part 2 cooperated with the adjustment transmission part 3 is pivoted on the U-shaped stand 6; a protective cover 1 is mounted on the hand-push part 2.

Through a cable adjusting sleeve 9 mounted within each U-shaped stand 9, the length and the degrees of tightness of the cable 18 are adjustable.

As shown by the FIGs, a moving part 24 is sleeved on each U-shaped stand 6, the moving part 24 is rotatable along the U-shaped stand 6, and provided with an arc-shaped hole 32; the two ends of the front stand 4 are fixedly connected to the two moving parts 24 on the two U-shaped stand 6 respectively through welding. Furthermore, each U-shaped stand is provided with a hole 33, and a spring leaf 25 of which one end is mounted with a spring leaf positioning part 26; one end of the spring leaf positioning part 26 penetrates the hole 33 and extents into the arc-shaped hole 32. Resulting from above structure, the walking aid according to the present invention could be folded for less space occupied in transportation or idle state, consequently reducing the cost in packing for transportation.

The moving part 24 is mounted with a moving part upper sleeve 27 on one end thereof, and a marble moving part 23 on the other end thereof, the moving part upper sleeve 27 and marble moving part 23 are rotatable following the moving part 24, a marble fixing part 20 cooperated with the marble moving part 23 is mounted on each U-shaped stand 6. Between the marble moving part 23 and the marble fixing part 20, a marble 22 and a marble spring 21 are mounted, the marble moving part 23 has two grooves 34 arranged in a certain angle on the end surface thereof for receiving the marble 22, the marble 22 are wedged in the grooves 34 for improving the stability of the walking aid according to the present invention in both use and folded states.

Each U-shaped stand 6 is mounted with a reinforcing pipe 8, for enhancing the strength of the present invention, consequently to improve the safety of the present invention.

Figure 5:
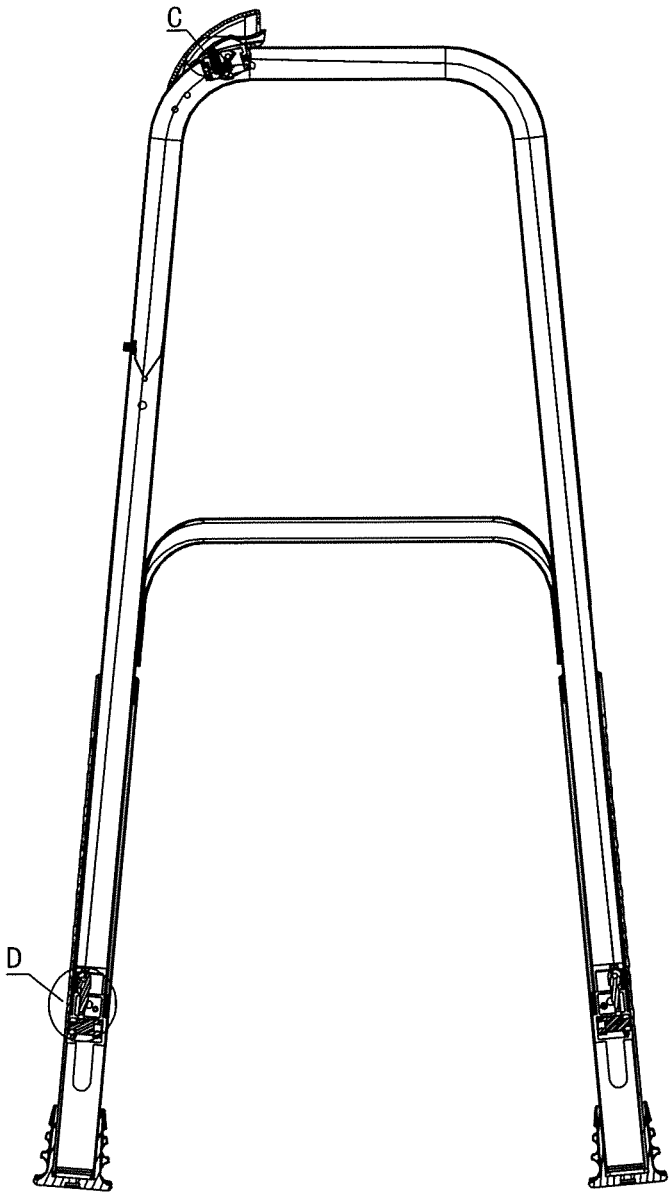
FIG. 5 is schematic view of the walking aid in height adjusting status.
Figure 6:
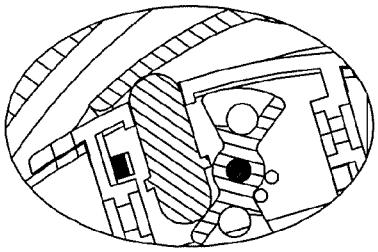
FIG. 6 is an enlarged view of the portion A in FIG. 4.
Figure 7:
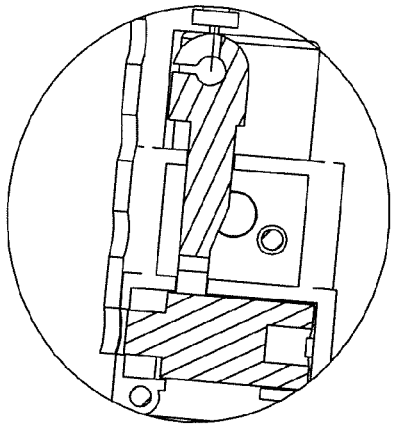
FIG. 7 is an enlarged view of the portion B in FIG. 4.
Figure 8:
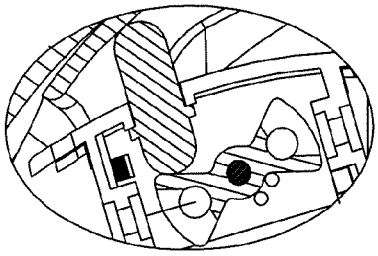
FIG. 8 is an enlarged view of the portion C in FIG. 5.
Figure 9:
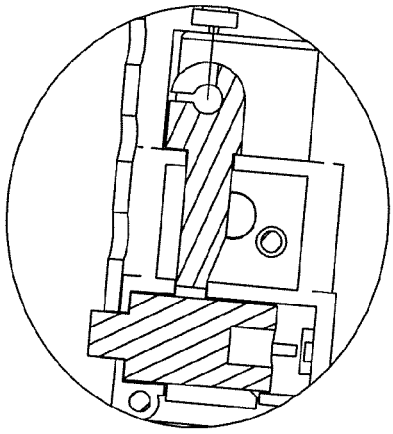
FIG. 9 is an enlarged view of the portion D in FIG. 5.

The height adjusting principle of the present invention is as: to adjust the height of the walking aid, the user could first open the protective cover 1, and then press down the hand-push part 2 to make the adjustment transmission part 3 move up and down to put the adjusting part 29 in rotation; the rotating adjusting part 29 further pulls the cable 18 and drives the inner driving medium 10 to move up and down; at the same time, driven by the cable 18, the inner moving part 12 is retracted into the outer pipe 17 and hereby leaves from the positioning hole 31 in the outer pipe 17, thus to enable the outer pipe 17 to move up and down along the U-shaped stand 6, so as to achieve the function of height adjustment desired, as shown in FIGS. 5, 8 and 9.

After adjusting the walking aid to a height desired, releasing the hand-push part 2, the inner driving medium 10 returns by the return spring, at that time the inner moving part 12 is wedged into a corresponding positioning hole 31 in the outer pipe 17, the height adjusting process is completed and the height of the walking aid is locked.

The folding and unfolding principle of the walking aid according to the present invention could be described as: to fold the walking aid, the user could turn the u-shaped stands 6 inwards with appropriate force, pressed by the marble 22, the marble 22 leaves from the groove 34 of the marble moving part 23, and goes into another groove 34 of the marble moving part 23, and the position is thus locked.

Another embodiment of the present invention is shown in FIG. 13 to 19, the difference between this embodiment and the embodiment described above lies in the control apparatus for height adjusting, in the second embodiment the control apparatus for height adjusting comprises two adjusting parts 29 and an adjustment transmission part 3 mounted in each U-shaped stand, one end of the adjustment transmission part 3 penetrates the U-shaped stand 6 and extents to the outside of the U-shaped stand 6, the other end is in contact with the two adjusting parts 29. The two adjusting parts 29 is sliding in the U-shaped stand 6 under the pressure of the adjustment transmission part 3, wherein one adjusting part 29 is connected with one inner driving medium 10 through a first cable 181, and the other adjusting part 29 is connected with the other inner driving medium 10 through a second cable 182, a hand-push part 2 cooperated with the adjustment transmission part 3 is pivoted on the U-shaped stand 6. In the U-shaped stand 6 an adjusting part installation box consisting of upper cover 28 and lower cover 30 is mounted, the adjusting part installation box is provided with a sliding groove 73, in which a the adjusting part 29 is mounted and hereby slides right and left along the sliding groove 37 in cooperation with the adjustment transmission part 3.

As shown by the FIGs, the adjusting part 29 has a inclined plane 291, accordingly the adjustment transmission part 3 has a wedge block 331 cooperated with the inclined plane 291, when the adjustment transmission part 3 being pushed down, the wedge block 331 push the inclined plane 291, consequently to slide the adjusting part 29.

As shown by the FIGs, one U-shaped stand 6 is mounted with a first connecting pipe 38, and the other U-shaped stand is mounted with a second connecting pipe 39, wherein one end of the first connecting pipe 38 is inserted into the second connecting pipe 39, and a connector 40 is mounted between the first and second connecting pipes 38 and 39 to lock the relative position of the first and second connecting pipes 38 and 39, and further enhance the stability of the walking aid. To unfold the walking aid according to the present invention, first remove the lock of the connector 40 on the first and second connecting pipes 38 and 39, and then retract the first connecting pipe 38 into the second connecting pipe 39.

A foam handle 41 is mounted on the hand grabbing portion of each U-shaped stand 6.

Figure 13:
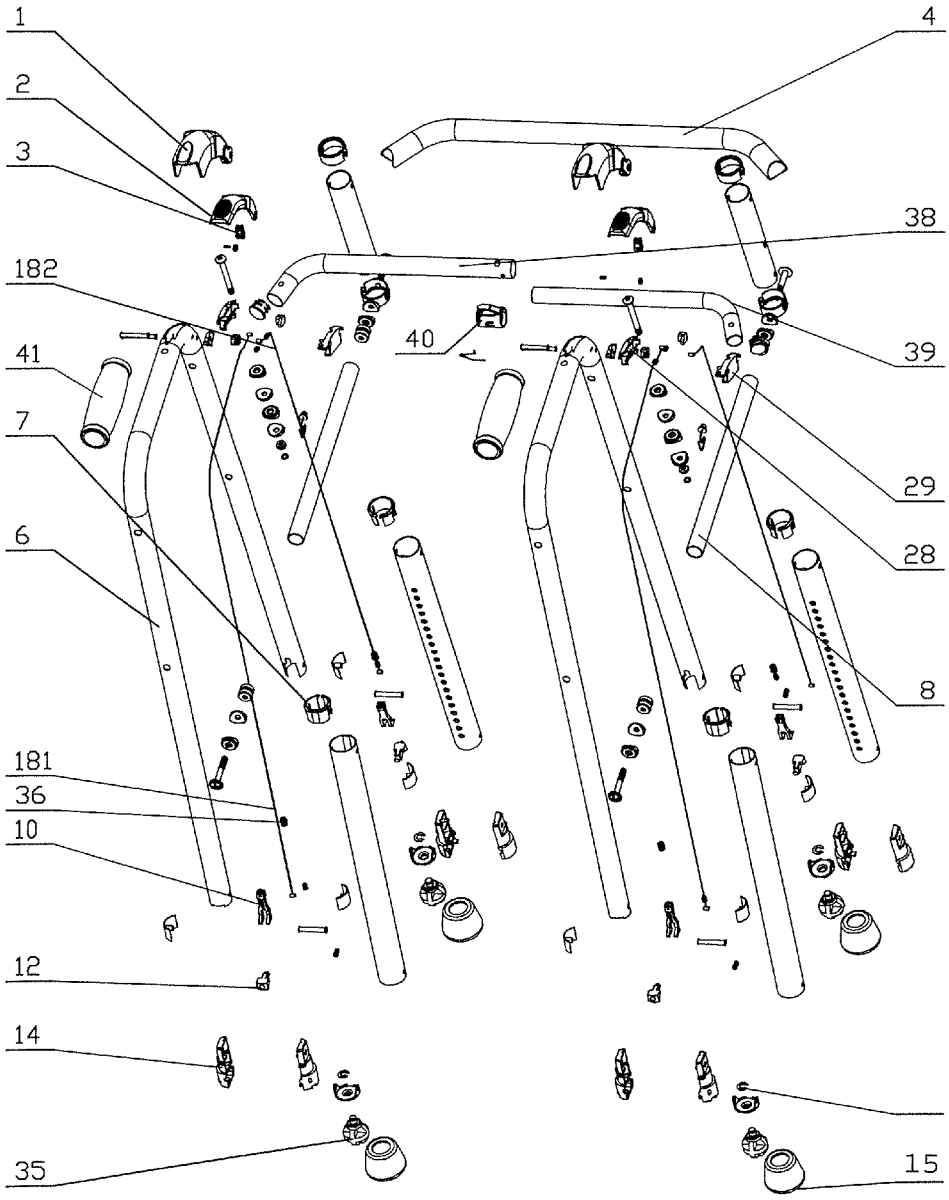
FIG. 13 is a solid diagram of the second embodiment of the present invention.
Figure 14:
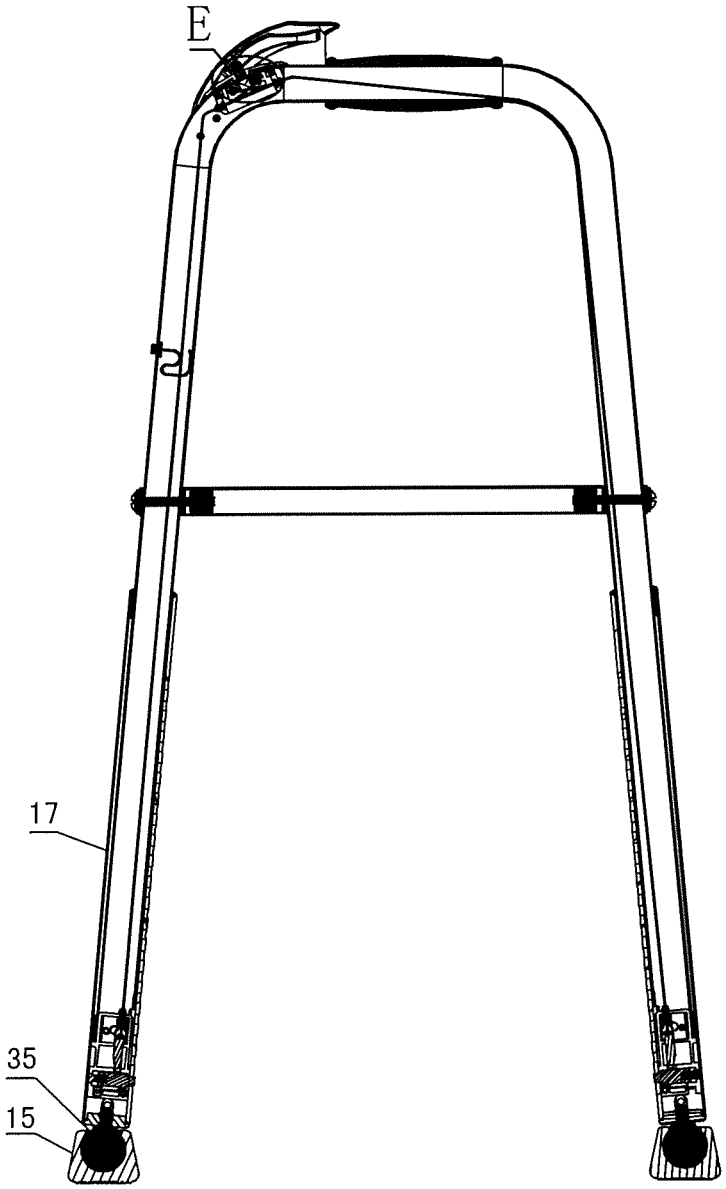
FIG. 14 is a cross-sectional view of the second embodiment of the present invention.
Figure 15:
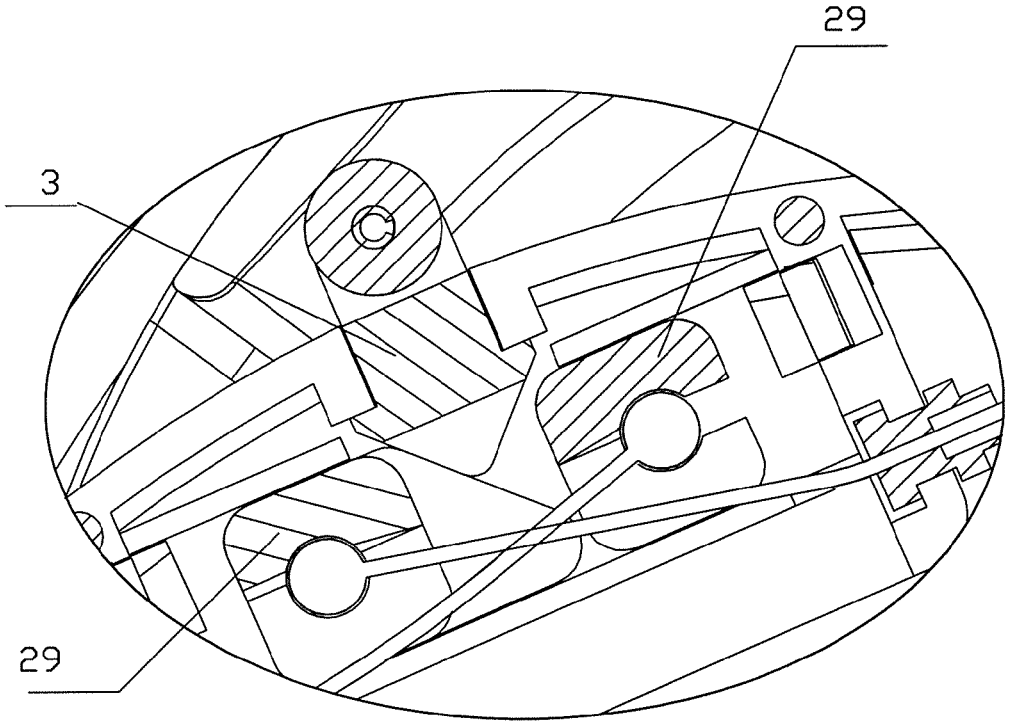
FIG. 15 is an enlarged view of the portion E in FIG. 14.
Figure 16:
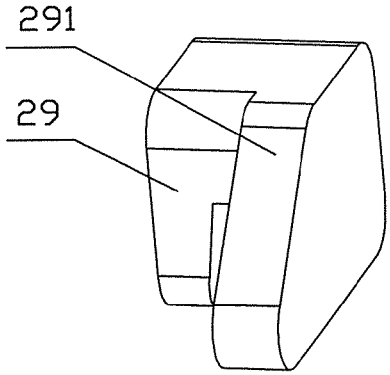
FIG. 16 is a solid diagram of the adjusting part adopted by the second embodiment of the present invention.
Figure 17:
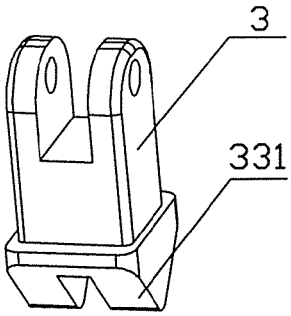
FIG. 17 is a solid diagram of the adjustment transmission part adopted by the second embodiment of the present invention.
Figure 18:
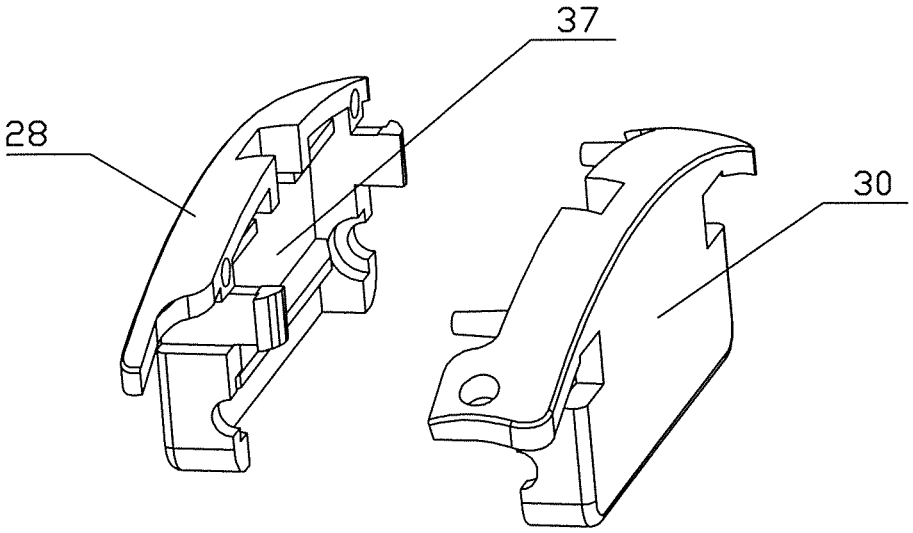
FIG. 18 is an exploded view of the adjusting part installation box adopted by the second embodiment of the present invention.
Figure 19:
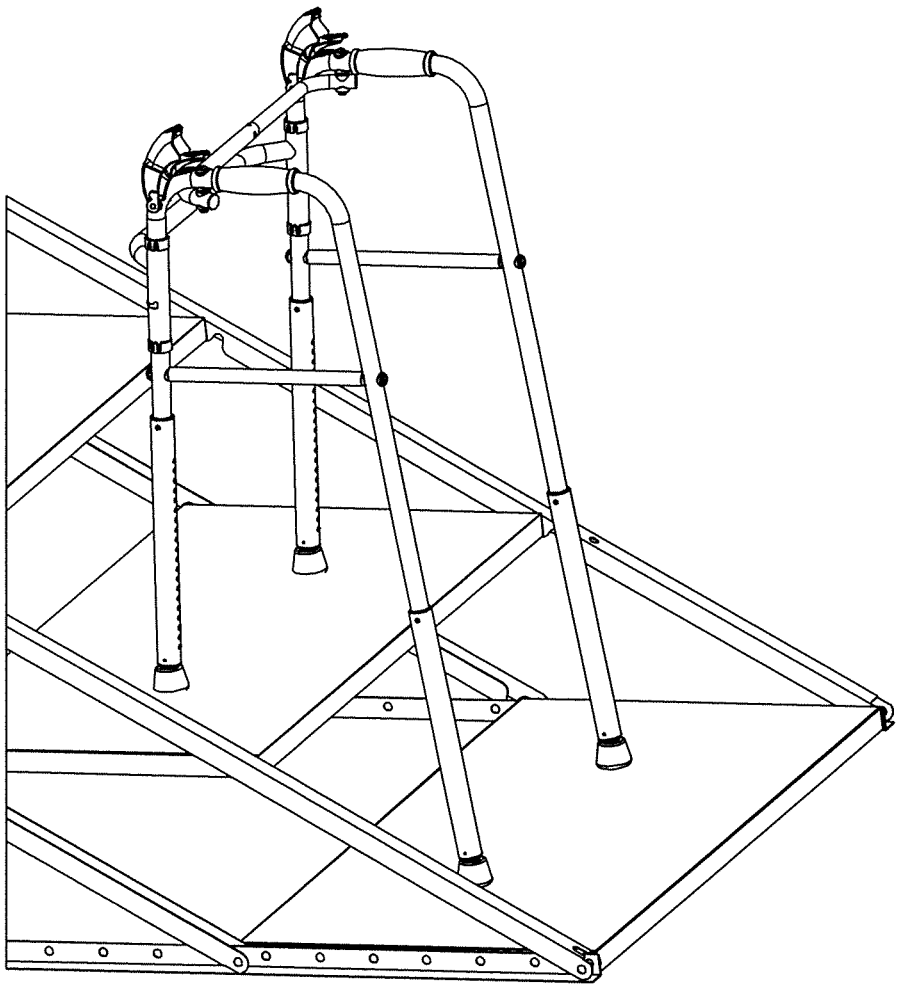
FIG. 19 is a schematic view of the second embodiment of the present invention in use status.

As shown by FIGS. 13 and 14, a rubber pad 15 is mounted on the end of each outer pipe 17 through an universal joint 35, thus, the rubber pads 15 is kept perpendicular to the contact surface when the walking aid according to the present invention is used on the uneven or inclined grounds, whereby enhancing the stability of the walking aid, as shown in FIG. 14.

The principle of the height adjustment of the walking aid according to the present invention could be described as: to adjust the height of the walking aid, at first pushing down the hand-push part 2, the hand-push part 2 pushes the adjustment transmission part 3 to move down, the wedge bock 331 of the adjustment transmission part 3 then pushes the inclined plane 291 of the adjusting part 29 to slide, the sliding adjusting part 29 moves the inner driving medium 10 by the cable, the inner driving medium 10 drives the inner moving part 12 to act radially along the U-shaped stand 6, consequently to retract the inner moving part 12 into the outer pipe 17 and leaves from the positioning hole 31 of the outer pipe 7, thus, the outer pipe 17 could move up or down freely along the U-shaped stand 6 to achieve the function of height adjusting. After a desired height is gained, releasing the hand-push part, the inner driving medium 10 returns to its initial position by the return spring 36, at that time the inner moving part 12 is clicked into a corresponding positioning hole 31 of the outer pipe 17, thus the height adjusting process is completed and the height of the walking aid is locked, meanwhile the inner driving medium 10 pulls the adjusting part 29 back through the cable when moving back, the returned adjusting part 29 pushes the adjustment transmission part 3 back to the initial position.

The invention claimed is:

1. A height self-adjustable walking aid, comprising two oppositely arranged U-shaped stands which are connected together by a front stand, a plurality of outer pipes which respectively sleeve the ends of each of said two oppositely arranged U-shaped stands, a height adjusting apparatus mounted between each outer pipe and the corresponding U-shaped stand, and a control apparatus for height adjusting mounted inside each U-shaped stand, the control apparatus allowing height adjustment in response to a pushing force actuation of said control apparatus, wherein each of said plurality of outer pipes is provided with a plurality of positioning holes in the sidewall thereof, and wherein said height adjusting apparatus mounted between each outer pipe and the corresponding U-shaped stand comprises an inner driving medium having a bar-shaped groove and a rigid inclined plane on a top surface thereof, and an inner moving part which is mounted in said bar-shaped groove of said inner driving medium, whereby one end of the inner moving part is insertable into one of said plurality of positioning holes and the other end is mounted with a reset spring, wherein said rigid inclined plane of said inner driving medium is configured to drive the inner moving part to move radially when the inner driving medium moves up or down.

2. The height self-adjustable walking aid according to claim 1, wherein said control apparatus for height adjusting comprises a cable disposed in the corresponding U-shaped stand wherein the two ends of said cable are each respectively and fixedly connected with an inner driving medium mounted in the corresponding U-shaped stand, an adjusting part which is pivotable in the U-shaped stand, wherein a middle part of the cable is fixedly connected to the adjusting part, an adjustment transmission part mounted in said corresponding U-shaped stand, wherein one end of said adjustment transmission part extends to the outside of the corresponding U-shaped stand and the other-end is in contact with the adjusting part, and a hand-push part which is pivotable in said corresponding U-shaped stand and which cooperates with the adjustment transmission part.

3. The height self-adjustable walking aid according to claim 2, wherein in each outer pipe an inner part is mounted, in which an inner moving part is mounted, and a reset spring is mounted between the inner moving part and the inner part.

4. The height self-adjustable walking aid according to claim 2, wherein in each corresponding U-shaped stand an adjusting part installation box is mounted, in which the adjusting part is mounted.

5. The height self-adjustable walking aid according to claim 1, wherein in each U-shaped stand a cable adjusting sleeve is mounted.

6. The height self-adjustable walking aid according to claim 1, wherein the control apparatus for height adjusting comprises a first cable and a second cable, each of which is disposed in the corresponding U-shaped stand and is respectively and fixedly connected with an inner driving medium mounted in the corresponding U-shaped stand, two adjusting parts, an adjustment transmission part, wherein one end of the adjustment transmission part extends to the outside of the corresponding U-shaped stand and the other end is in contact with the two adjusting parts, the two adjusting parts being moveable within the corresponding U-shaped stand under pressure by the adjustment transmission part, and a hand-push part which is pivotable in said corresponding U-shaped stand and which cooperates with said adjustment transmission part, wherein one of said two adjusting parts is connected with an inner driving medium through the first cable and the second of said two adjusting parts is connected with a second inner driving medium through the second cable.

7. The height self-adjustable walking aid according to claim 6, wherein each adjusting part has an inclined plane and each adjustment transmission part has a wedge block which cooperates with the inclined plane of the corresponding adjusting part.

8. The height self-adjustable walking aid according to claim 6, further comprising an adjusting part installation box mounted in each U-shaped stand, the adjusting part installation box having a sliding groove in the inside thereof, in which an adjusting part is mounted.

9. The height self-adjustable walking aid according to claim 1, further comprising a moving part sleeved on each U-shaped stand, wherein the moving part is rotatable about the U-shaped stand and has an arc-shaped hole, a spring leaf mounted in each U-shaped stand, and a spring leaf positioning part for each respective spring leaf, one end of said spring leaf being mounted with said spring leaf positioning part, wherein two ends of the front stand are respectively and fixedly connected with the moving parts on the two U-shaped stands, each U-shaped stand having a hole, and wherein one end of each said spring leaf positioning part penetrates the hole in the U-shaped stand and extends into the arch-shaped hole of the moving part.

10. The height self-adjustable walking aid according to claim 9, further comprising a moving part upper sleeve for each said moving part, wherein one end of said each moving part is mounted with said moving part upper sleeve, a marble moving part for each said moving part, wherein the other end of each moving part is fixedly connected with said marble moving part, a marble fixing part for each said moving part, wherein said marble fixing part is mounted in the U-shaped stand and cooperates with said marble moving part, and a marble and a marble spring which are mounted between the marble moving part and the marble fixing part, the marble moving part having groove on the end surface thereof for receiving the marble.

11. The height self-adjustable walking aid according to claim 1, further comprising a reinforcing pipe mounted on each U-shaped stand.

12. The height self-adjustable walking aid according to claim 1, further comprising a rubber pad mounted on the end of each outer pipe through a universal joint.

13. The height self-adjustable walking aid according to claim 1, further comprising a foam handle mounted on a hand grabbing portion of each U-shaped stand.

14. The height self-adjustable walking aid according to claim 1, further comprising a first connecting pipe, wherein one of the U-shaped stands is mounted with said first connecting pipe, a second connecting pipe, wherein another of the U-shaped stands is mounted with said second connecting pipe, wherein one end of the first connecting pipe is inserted into the second connecting pipe, and a connector mounted between the first connecting pipe and the second connecting pipe.

15. The height self-adjustable walking aid according to claim 1, wherein said inner driving medium has a return spring.

* * * * *